US011401751B2

(12) United States Patent
Gissler

(10) Patent No.: US 11,401,751 B2
(45) Date of Patent: Aug. 2, 2022

(54) HIGH PRESSURE ELECTRICAL CONNECTOR CABLE FOR OIL AND GAS APPLICATIONS

(71) Applicant: Halliburton Energy Services, Inc., Houston, TX (US)

(72) Inventor: Robert William Gissler, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 64 days.

(21) Appl. No.: 17/011,191

(22) Filed: Sep. 3, 2020

(65) Prior Publication Data

US 2021/0098151 A1 Apr. 1, 2021

Related U.S. Application Data

(60) Provisional application No. 62/908,279, filed on Sep. 30, 2019.

(51) Int. Cl.

| | |
|---|---|
| ***E21B 17/02*** | (2006.01) |
| ***E21B 33/035*** | (2006.01) |
| ***E21B 33/038*** | (2006.01) |
| ***E21B 17/00*** | (2006.01) |
| ***H01B 7/02*** | (2006.01) |
| ***H01B 7/18*** | (2006.01) |

(Continued)

(52) U.S. Cl.

CPC ..... *E21B 17/0285* (2020.05); *E21B 17/003* (2013.01); *E21B 33/0355* (2013.01); *E21B 33/0385* (2013.01); *H01B 7/0216* (2013.01); *H01B 7/1895* (2013.01); *H01B 7/20* (2013.01); *H01R 13/111* (2013.01); *H01R 13/5221* (2013.01); *H01R 2101/00* (2013.01)

(58) Field of Classification Search

CPC ..... H01R 13/521; H01R 13/187; H01B 7/046

See application file for complete search history.

(56) References Cited

U.S. PATENT DOCUMENTS

| | | | |
|---|---|---|---|
| 4,074,926 | A | 2/1978 | Broad |
| 5,191,173 | A | 3/1993 | Sizer et al. |

(Continued)

OTHER PUBLICATIONS

Chromalox Heating Cable Specification Sheet.

(Continued)

*Primary Examiner* — Jean F Duverne

(74) *Attorney, Agent, or Firm* — Haynes and Boone, LLP

(57) ABSTRACT

Downhole connection assemblies include a connector to receive a conductor and pin at opposite ends. The connector includes a first electrical collet, a separate second electrical collet and a sleeve. The first collet includes a first recess in a first end to receive the conductor and a second recess in a second end to receive the pin. The second collet is positioned around the pin and separated from the first collet. The sleeve is positioned around the pin, first collet and the second collet. Downhole cables include a center electrical conductor, a first insulator positioned around the center conductor, a second insulator positioned around the first insulator, and a pressure tube surrounding the second insulator. The cable further includes one or more slots extending axially along a length of the second insulator, or one or more slots extending axially along an inner diameter of the pressure tube.

20 Claims, 11 Drawing Sheets

(51) Int. Cl.

| | |
|---|---|
| ***H01B 7/20*** | (2006.01) |
| ***H01R 13/11*** | (2006.01) |
| ***H01R 13/52*** | (2006.01) |
| ***H01R 101/00*** | (2006.01) |

(56) References Cited

U.S. PATENT DOCUMENTS

| | | | | |
|---|---|---|---|---|
| 7,355,122 | B2 | 4/2008 | Moore | |
| 7,700,873 | B2 * | 4/2010 | Aumoitte | H01B 9/028 174/36 |
| 8,734,175 | B2 | 5/2014 | Ayers | |
| 10,219,326 | B2 | 2/2019 | Mosebach et al. | |
| 2004/0062497 | A1 | 4/2004 | Plemmons et al. | |
| 2004/0163801 | A1 | 8/2004 | Dalrymple et al. | |
| 2010/0116510 | A1 | 5/2010 | Varkey et al. | |
| 2017/0145755 | A1 | 5/2017 | Tilley et al. | |
| 2018/0174710 | A1 * | 6/2018 | Rogers | H01B 7/295 |
| 2018/0190409 | A1 * | 7/2018 | Ghorbani | H01B 9/027 |
| 2020/0168359 | A1 * | 5/2020 | Kohori | H01B 7/0869 |

OTHER PUBLICATIONS

Conax Technologies Mineral Insulated Cable Specification Sheet.
Nelson Mineral Insulated Cable Specification Sheet.
Pyrotenax MI Enhanced Grade MI Wiring Cable System Catalogue.
Watlow Mineral Insulated Cable Specification Sheet.
International Search Report and The Written Opinion of the International Search Authority, or the Declaration, dated Nov. 27, 2020, PCT/US2020/048382, 12 pages, ISA/KR.
International Search Report and The Written Opinion of the International Search Authority, or the Declaration, dated Dec. 3, 2020, PCT/US2020/049128, 10 pages, ISA/KR.

* cited by examiner

HIGH PRESSURE ELECTRICAL CONNECTOR CABLE FOR OIL AND GAS APPLICATIONS

PRIORITY

The present application is a Non-Provisional patent application of and claims priority to U.S. Provisional Application No. 62/908,279, filed Sep. 30, 2019, entitled "HIGH PRESSURE ELECTRICAL CONNECTOR ASSEMBLY FOR OIL AND GAS APPLICATIONS HAVING SEPARATE ELECTRICAL COLLETS," also naming Bob Gissler as inventor, the disclosure of which is incorporated herein by reference in its entirety.

FIELD OF THE DISCLOSURE

The present disclosure relates generally to high pressure electrical cables and connectors for use in oil and gas applications and particularly to an electrical connector cable and assembly having separate electrical collets to combat the adverse effects of thermal expansion or contraction on the connector.

BACKGROUND

The high pressures and temperatures associated with oil and gas explorations (e.g., downhole pressure in wells can exceed 30,000 psi) require electrical connectors that can accommodate wear, temperature expansion, and temperature cycling without permitting unintended disconnections or intrusion of pressurized fluids. Typically, instrument wire is installed in oil and gas wells extending along a downhole formation to communicate electrical signals and power between downhole well tools and the surface. Because of the high pressures and temperatures typically found in wells, instrument wire is sheathed to prevent deterioration of the wire. Instrument wire typically is constructed with a multi-strand or solid electrical conductor clad with one or two layers of thermoplastic material and with an outer stainless-steel sheath. The wire must then be cut and terminated so electrical connections can be made at various places along the completion string. Various connectors have been made to form downhole connections including, for example, those described in U.S. Pat. No. 5,833,490 (Bouldin) or U.S. Pat. No. 6,056,327 (Bouldin et. al).

However, such convention connectors have drawbacks. For example, due to higher environmental pressure and the thermal expansion differences between various components of the connector assembly, there can be some relative movement between the connector components and the electrical cable components. Such movement can result in unintended disconnections, forcing electrical components apart or together, or fluid intrusion into the connections causing open or short circuits.

DESCRIPTION OF ILLUSTRATIVE EMBODIMENTS

Embodiments and related methods of the present disclosure relate to high-pressure electrical connection assemblies and cables for use in oil and gas applications. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

As will be described in further detail below, embodiments of the present disclosure may be used for connecting an electrical conductor of a cable to an electrical pin for use in an oil and gas application, such as a downhole application in a well extending along a hydrocarbon formation. In a generalized embodiment, a high-pressure electrical connection assembly includes a housing having a bore therein to receive the electrical conductor. A connector is positioned within the bore to receive the electrical conductor in a first end and the electrical pin in a second end, to thereby maintain electrical contact between the electrical conductor and electrical pin. The connector includes a first electrical collet, a separate second electrical collet and a sleeve. The first electrical collet includes a first recess in a first end to receive the electrical conductor (they can be joined together using e.g., a solder or a mechanical crimp) and a second recess in a second end to receive the electrical pin (this connection may be made, e.g., as an I-wire termination boot kit and the high pressure electrical connector are threaded together). The second electrical collet is positioned around the electrical pin and physically separated from the first electrical collet. The sleeve is positioned around the electrical pin, first electrical collet and the second electrical collet. Both collets make physical contact with the electrical pin. By separating the collets, the electrical contact area is essentially doubled while providing enhanced mechanical and electrical collet properties, thereby resulting in a joint that is more efficient, more effective and more forgiving. By separating the collets, each collet can be optimized (e.g., through manipulation of shape, configuration and material selection and properties) to fulfill their mechanical and electrical functions. Moreover, through use of the separate electrical collets, and other components described herein, the illustrative connectors require pounds of force to disconnect versus ounces of force as in conventional connectors.

Figure 1:
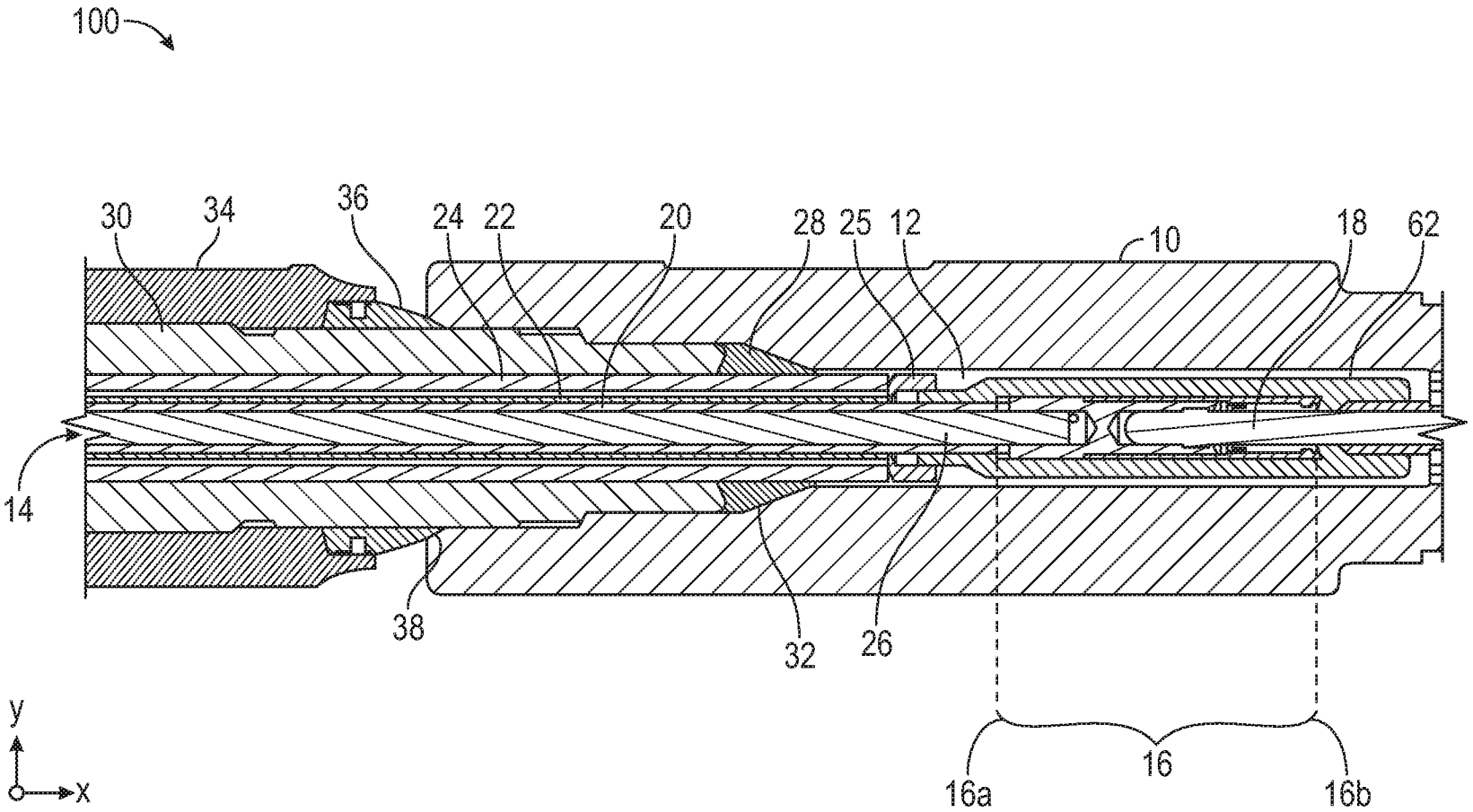
FIG. 1 is a sectional view of a high-pressure connection assembly according to certain illustrative embodiments of the present disclosure.

FIG. 1 is a sectional view of a high-pressure connection assembly according to certain illustrative embodiments of the present disclosure. High-pressure electrical connection assembly 100 includes housing 10 (also referred to as a high-pressure bulkhead connector) having a center electrical pin 18 and a bore profile 12 which forms a hollow space within housing 10. Bore 12 receives a boot kit including a boot 62 (including connector 16) and a full metal jacketed ("FMJ") Instrument ("I") wire 14. The FMJ isolates the electrical connection from the down-hole environment (or other external environment). As will be described in more detail below, I-wire 14 includes an outer tube the FMJ seals against, as well as an insulator layer or layers and an electrical center conductor 26. The boot kit includes a connector 16 positioned within bore 12 to receive electrical conductor 26 at first end 16*a* and electrical pin 18 at second end 16*b*, along with boot 62. Connector 16 maintains electrical contact between electrical conductor 26 and electrical pin 18, as described herein.

In this example, I-wire 14 comprises insulation layer 20, insulation layer 22 positioned over layer 20, metal sheath or jacket 24, and electrical conductor 26. Metal ferrule set or seal 28 is positioned between jacket 24 and housing 10, and is contacted by primary retainer 30 which is engaged (e.g., via a thread) with housing 10. Rotation of retainer 30 relative to housing 10 urges seal set 28 against housing bevel 32, which forces seal 28 into contact with housing 10 and metal jacket 24 to form a fluid tight metal-to-metal seal. A secondary retainer 34 is positioned around primary retainer 30 via a thread, for example. Rotation of secondary retainer 34 relative to primary retainer 30 urges seal set 36 into contact with bevel 38 of housing 10 and primary retainer 30 to form a fluid tight metal-to-metal seal. Such connections also provide a strong mechanical connection between housing 10 and I-wire 14 and helps to prevent relative movement in axial and rotational directions.

Sheath/pressure tube 24 and insulation layer 22 are shorter than insulation layer 20 to leave a portion of insulation layer 20 exposed to allow boot 62 to seal around the exposed portion of insulation layer 20. Insulation layer 22 is cut essentially flush with the end of sheath/pressure tube 24 and may have slots to provide room for the insulation material to expand when the I-wire is exposed to high temperature and/or pressure, as will be described in greater detail below. Insulation layer 22 and pressure tube 24 terminate at electrically insulating lateral support 25 which provides provide lateral support if the internals of I wire 14 (or surrounding components) move excessively in either direction. In addition, a portion of conductor 26 extends out beyond insulation layer 20. The exposed portion of conductor 26 is attached to end section 16*a* of connector 16 via any suitable means, such as, for example, soldered, welded, crimped or otherwise rigidly fastened to connector 16 end section 16*a*. End section 16*b* also could include a solder profile to attach to electrical pin 18, but may also be connected thereto using other suitable means as mentioned herein.

Figure 2:
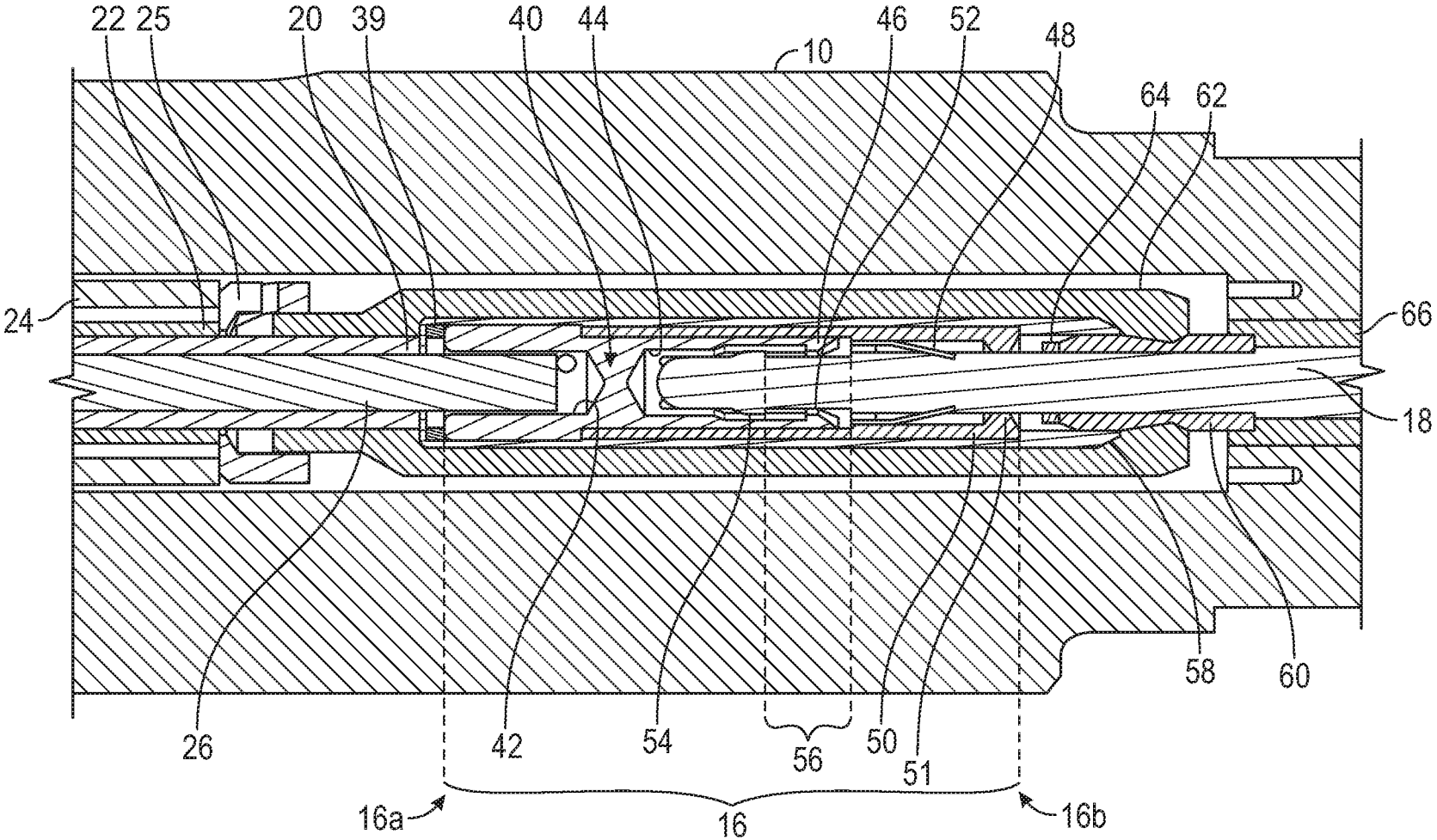
FIG. 2 is a close-up cross-section view of a disclosed electrical connector useful to more fully explain the illustrative embodiment of the present disclosure.

FIG. 2 is an expanded sectional view of the housing/bulkhead connector 16. This figure is useful to more fully explain the illustrative embodiment of the present disclosure. In this example, connector 16 includes a first electrical collet 40, second electrical collet 48, and sleeve 50. First electrical collet 40 of connector 16 includes a first recess 42 in one end to receive electrical center conductor 26. First electrical collet 40 is secured between sleeve 50 and spacer 39 located at one end of insulator 58. First electrical collet 40 of connector 16 also includes a second recess 44 formed by first electrical collet fingers 46 in a second end to receive electrical pin 18. Second electrical collet 48 is also positioned around electrical pin 18 and is a separate component from first electrical collet 40.

As discussed herein, because of the separation of first electrical collet 40 from second electrical collet 48, the robustness of the connection is noticeably increased vs. conventional connectors. Sleeve 50 is made of conductive material and positioned around/straddles electrical pin 18, second electrical collet 48 and first electrical collet 40. As can be seen, second electrical collet 48 includes a first end in contact with sleeve 50 (e.g., press fitted, welded, epoxied, brazed, etc. against sleeve 50) and a second end compressed against electrical pin 18 to establish the electrical connection. In addition, sleeve 50 provides support against high external pressure and can also have an electrical contact face 51 to provide electrical contact with pin 18.

Sliding engagement between connector end section 16*b* and electrical pin 18 permits electrical pin 18 to remain in electrical contact with electrical conductor 26 while permitting relative movement between end connector section 16*b* and electrical pin 18. First electrical collet fingers 46 include contact faces 52 which compress against the outer diameter ("OD") of electrical pin 18 to establish the electrical connection. Electrical pin 18 includes an upset diameter face 54 which mates against contact faces 52 of collet fingers 46 when electrical pin 18 is moved in an axial direction away from electrical conductor 26 (or vice versa); this configuration works to prevent premature separation of the electrical connection. Upset diameter face 54 may be formed on the OD of electrical pin 18 in a variety of ways, such as, for example, machining. During the assembly process, first electrical collet fingers 46 slide over the top of upset diameter face 54 and snap into recess 56 formed in electrical pin 18 right behind upset diameter face 54.

First electrical collet 40 may be made of a variety of materials that exhibit properties allowing it to accommodate high mechanical stresses and high temperature, such as a copper alloy for example. One example material is copper beryllium which provides high temperature mechanical and electrical performance (e.g., acceptable performance up to 200 C or higher), good electrical conductivity (e.g., 6 TO 21% International Annealed Copper Standard ("IACS"), high mechanical strength (e.g., 135 to 205 ksi yield strength]), stress relaxation resistance (e.g., 55 to 100% strength remaining) and is formable. When electrical pin 18 is moved away from conductor 26 such that the contact face of collet fingers 46 mates against upset diameter 54 of pin 18, the use of copper beryllium (or other suitable material) provides sufficient strength to maintain contact with electrical pin 18 against at least 5 to 50 pounds of separation force depending on the material strength and the angle of contact between contact face 46 and upset diameter 54.

Figure 3:
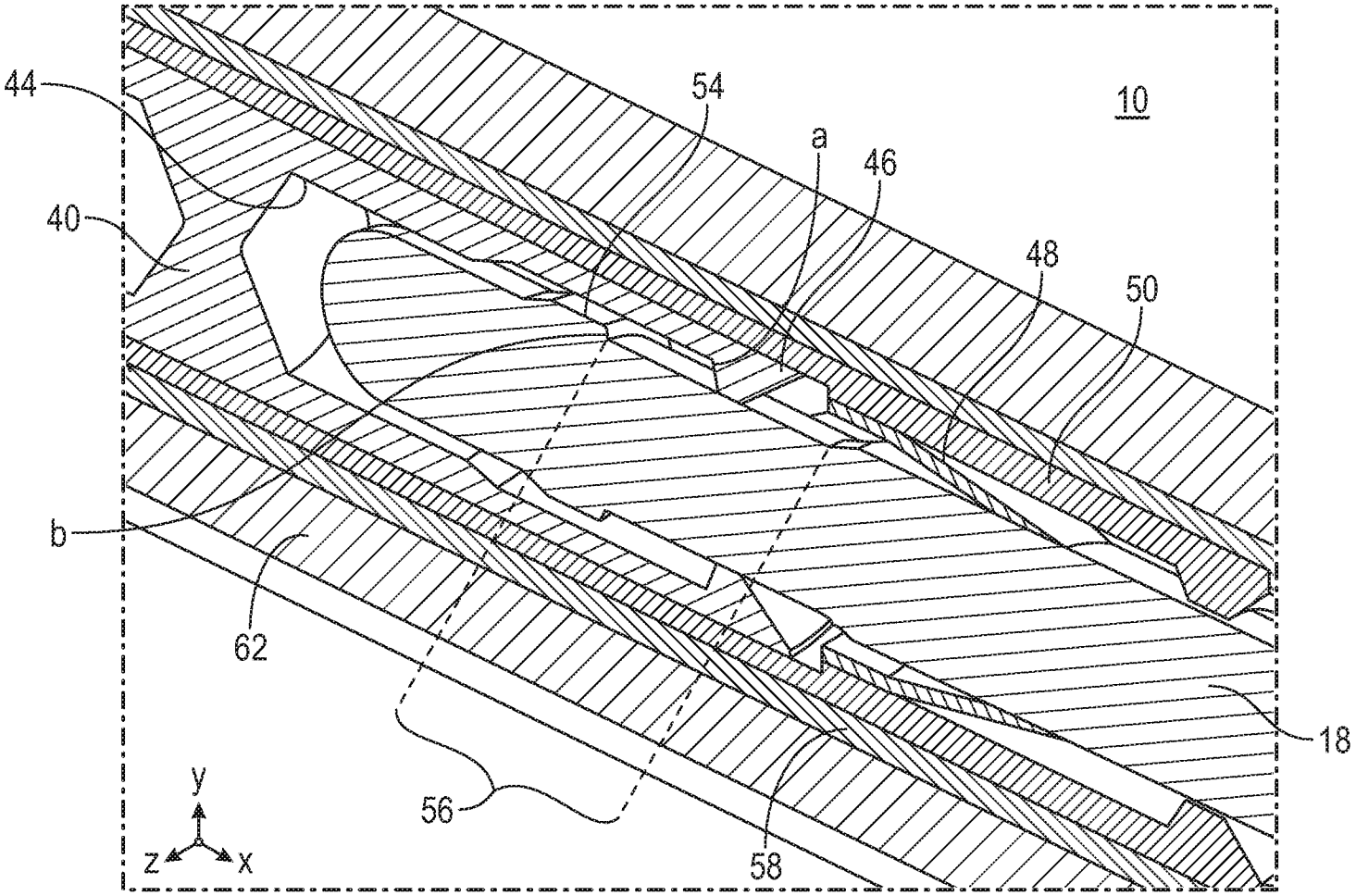
FIG. 3 is a three-dimensional view of a disclosed electrical connector useful to further illustrate the mating of the contact face with the upset diameter, as described herein.

FIG. 3 is a three-dimensional view of connector 16 useful to further illustrate the mating of the contact face of collet fingers 46 with upset diameter 54. Mating surface a of the contact face of collect fingers 46 and mating surface b of upset diameter 54 are shown. In this illustrative embodiment, the angles of mating surfaces a,b are shown as 70 degrees. However, the mating angles can be adjusted to increase or reduce the holding force, as would be understood by those ordinarily skilled in the art having the benefit of this disclosure.

Second electrical collet 48 may be made of a variety of materials that exhibit properties allowing it to accommodate high electrical power and high temperature, such as a nickel alloy for example. One example material is nickel beryllium or nickel cobalt which provides high temperature performance (e.g., acceptable performance up to 200 C or higher), good electrical conductivity (e.g., 4 to 24% IACS), high mechanical strength (e.g., 180 to 245 ksi), high stress relaxation resistance (e.g., 94 to 100% strength remaining) and is also formable.

Referring back to FIG. 2, the disclosed embodiments may take a variety of dimensions. For example, in FIG. 2 the main OD of first electrical collet 40 may be in the range of 0.1-0.15 inch and the OD at the collet fingers 46 where sleeve 50 fits over may be from 0.08-0.13 inches. The OD of electrical pin 18 may be 0.062-0.08 inches and the OD of reduced diameter 56 may be 0.052-0.07 inches. In another more specific example, the main OD of first electrical collet 40 is 0.140 inch and the OD at the collet fingers 46 where sleeve 50 fits over is 0.1168. The OD of electrical pin 18 is 0.078 and the OD of reduced diameter 56 is 0.068.

Still referencing FIG. 2, an insulator 58 is positioned around connector 16 such that it straddles connector 16 and a sleeve 60 positioned around electrical pin 18. Insulator 58 may be made of a variety of materials including, for example, polymers or other suitable materials. Sleeve 60 can be made of sapphire and may be separated from or suitably joined to electrical pin 18. Also, sleeve 60 is separated from sleeve 50 along the axis of electrical pin 18.

In certain illustrative embodiments, a shape memory shrink ring 64 can be positioned to the left of sleeve 60 to thereby clamp it to electrical pin 18. Ring 64 may be activated by heat at the housing 10 level. Once activated, ring 64 shrinks to generate a clamping force against center pin 18 to secure it into place. In yet other illustrative embodiments, an insulating material like epoxy, cement, non-conductive material (RTV-like) may be used along with ring 64 to secure sleeve 60 to pin 18 and to bead material 66. The bead material can be various compositions with the main constituents being, for example, either glass or ceramic. Ring 64 may be used in place of or in addition to bonding of sleeve 60 to the bead material 66 during the firing process. Such an embodiment also has the potential to simplify the build process for connector 16. In addition, bead 66 may be fused to electrical pin 18 and housing 10 to provide a pressure/electrical barrier/insulation.

Insulator 58 may be made of polyetheretherketone (PEEK) and provides radial support for connector 16 as well as a soft stop for connector 16 in the event it moves toward electrical conductor 26. Boot 62 is positioned around insulator 58 and may be made of rubber, for example. Boot 62 forms a seal on insulator 20 at one end and on sleeve 60 at the opposite end. Boot 62, insulator 20 and sleeve 60 combine to form an insulation barrier between the outer environment and the internal electrical conductor path formed by the electrical conductor 26, the electrical connector 16 and the electrical pin 18. Insulator 22 is cut to allow boot 62 enough length to adequately seal against the inner insulator 20.

Figure 4:
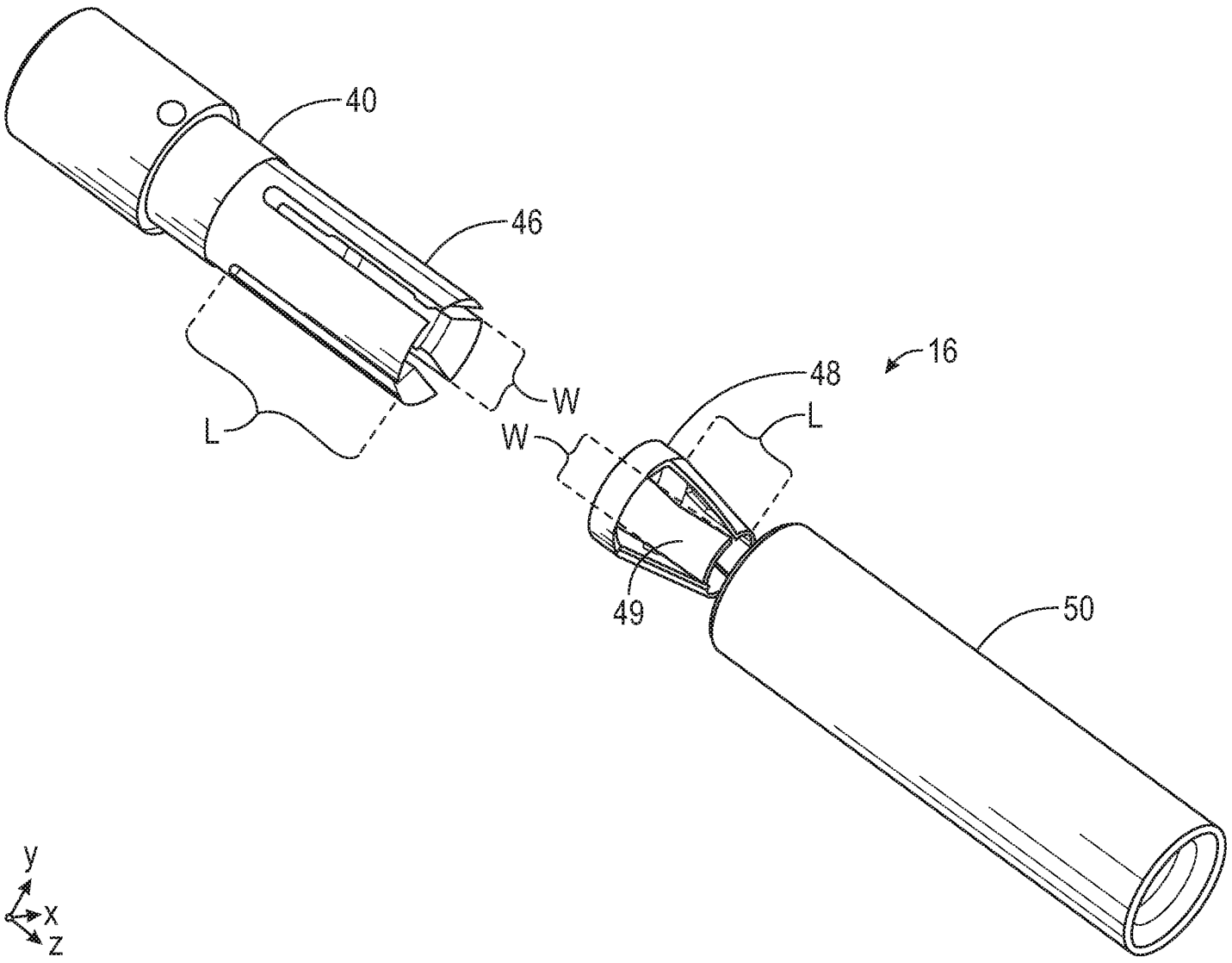
FIG. 4 is a three-dimensional expanded view of the individual components of a disclosed electrical connector subassembly.

FIG. 4 is a three-dimensional exploded view of the components of connector 16. As can be seen, connector 16 is a concentric component which includes first electrical collet 40, a separate second electrical collet 48 and sleeve 50, all of which are concentric components. Sleeve 50 may be comprised of a variety of conducting materials including, for example, MP35N, a Nickel-Cobalt base alloy. Although not shown, boot 62 and insulator 58 are also concentric components provide 360 degree seals around their mating components.

In yet other illustrative embodiments, the configuration of the electrical collects may be modified to alter their resonant frequencies. The configuration of the collets as described herein may include the collet material, shape, length, width, or thickness/depth of the collet fingers of both electrical collets. By configuring the electrical collets differently, the connection reliability of the assembly will be improved because the fingers of both electrical collets will behave different in the presence of vibration near the connection assembly.

Vibration can be present around the connection assembly for a number of reasons. For example, the vibration could be caused by flow velocities or eddy currents. The vibration could be flow-induced vibration if the connection assembly is used in completion equipment or drilling vibration if used in a measurement-while-drilling ("MWD") or logging-while-drilling ("LWD") application. The same would be true in an aerospace application or in any application where vibration may be present.

Altering the configuration of the first and second electrical collets results in the collects having different resonances. As a result, the connector 16 maintains electrical contact during vibration. For example, with reference to FIG. 4, the lengths L and widths W of first electrical collet fingers 46 and second electrical collet fingers 49 are different. In addition, the thicknesses of fingers 46,49 may also be different to further differ the resonances of both. As a result, the fingers will respond noticeably different to vibration frequencies. The longer, less wide fingers will respond to lower frequencies or frequency ranges. The shorter wider fingers will respond to noticeably higher frequencies or frequency ranges. Such modifications are well within the skill of those ordinarily skilled in the art having the benefit of this disclosure.

If the environmental conditions generate lower frequency vibrations with high enough amplitudes, it is possible the longer fingers may resonate or may begin making only intermittent contact with electrical pin 18—which could adversely affect the electrical continuity of connection 16. If the environmental conditions generate higher frequency vibrations with high enough amplitudes, it is possible the shorter fingers may resonate or may begin making only intermittent contact with electrical pin 18—which could also adversely affect electrical continuity. Therefore, by altering the configuration of the various collet fingers described herein, if one of the collect fingers (e.g., fingers 46) began to resonate and started making intermittent contact with pin 18, the other collect fingers (e.g., fingers 49) would maintain continuous contact. Such a configuration would result in a more robust electrical connection vs. conventional connectors who do not consider resonance. Moreover, the same would be true when shocks are applied to the connection assembly. The frequency differences between the collets/collet fingers will vary depending on the detailed configurations. The configurations of embodiments described herein may be adjusted based upon expected vibration-inducing applications/conditions.

In certain examples, the difference in resonant frequencies will be several hundred hertz or more. In certain illustrative embodiments, a collet combination example is included below.

1. Smaller collet fingers (e.g., second electrical collet 48):
   a. Dimensions: 0.006 inches thick, 0.050 inches wide, and 0.10 inches long.
   b. Moment of inertia of approx. $9\times10^{-10}$ inch^4
   c. Modulus of elasticity of $29\times10^{6}$ psi
   d. Density of 0.29 $lb/in^3$
2. Larger collet fingers (e.g., first electrical collet 40)
   a. Dimensions: 0.012 inches thick, 0.070 inches wide, and 0.22 inches long.
   b. Moment of inertia of approx. $1\times10^{-8}$ inch^4
   c. Modulus of elasticity of $19\times10^{6}$ psi
   d. Density of 0.29 $lb/in^3$ This example would result in a frequency response difference of approximately 7 to 10 times with the smaller collet fingers responding to the much higher frequencies.

As mentioned above, the strength/robustness of the electrical connection provided by the disclosed embodiments is significantly increased when compared to conventional connectors. In conventional electrical connectors used in the oil and gas industry, the electrical connections are combined into a single collet or spring assembly. Such a design is disadvantageous because it only takes a few ounces of separation force to result in a disconnection/open circuit of the connector. In stark contrast, however, the disclosed illustrative embodiments which utilize separate electrical collets, in addition to the mating surfaces a,b which engage when the pin 18 is pulled away from conductor 26, results in a connector that requires pounds of separation force to result in a disconnection. In addition, the disclosed first electrical collet can be less stiff and still provide increased holding force vs. conventional designs because of the overlapping contacting surfaces a,b. Also, design of the disclosed electrical collets allow more radial room for the sleeve 50 and insulation 58 which results in even higher retention force, increased electrical resistance to the environment and ability to accommodate higher environmental pressure.

Accordingly, the disclosed electrical connection assemblies will reduce and/or eliminate the negative effects of the relative differences in coefficients of thermal expansion of the various components of the assembly that cause unwanted movement of the I-Wire internals when subjected to high environmental temperature and pressure. Conventional connection assemblies possess traits that contribute to unwanted movement of the I-wire internals. This unwanted movement can in turn cause the electrical connection to physically separate or be forced together, thus resulting in an open or short circuit. Therefore, a much stronger connection assembly is provided by the illustrative embodiments described herein. The additional electrical contact areas provided by the additional collet fingers also provide a more reliable electrical connection as well as being able to accommodate higher electrical power.

In addition, the disclosed electrical connection assemblies may be used in any variety of oil and gas applications. Illustrative applications include, for example, subsea or downhole completion strings and/or any components associated therewith.

In other aspects of the present disclosure, downhole cables for use in oil and gas applications will now be disclosed to physically stabilize the electrical connection assemblies. In a generalized embodiment, the downhole cable includes a center electrical conductor, a first insulator positioned around the center electrical conductor, a second insulator positioned around the first insulator, and a pressure tube surrounding the second insulator. The cable also includes one or more slots extending axially along the length of the second insulator or one or more slots extending axially along the inner diameter of the pressure tube. This cable configuration minimizes the relative movement of the internal parts relative to each other and allows the connection assemblies to remain positionally stable even at higher temperatures and pressures. This design, in turn, increases the stability of the connection assemblies.

Figure 5:
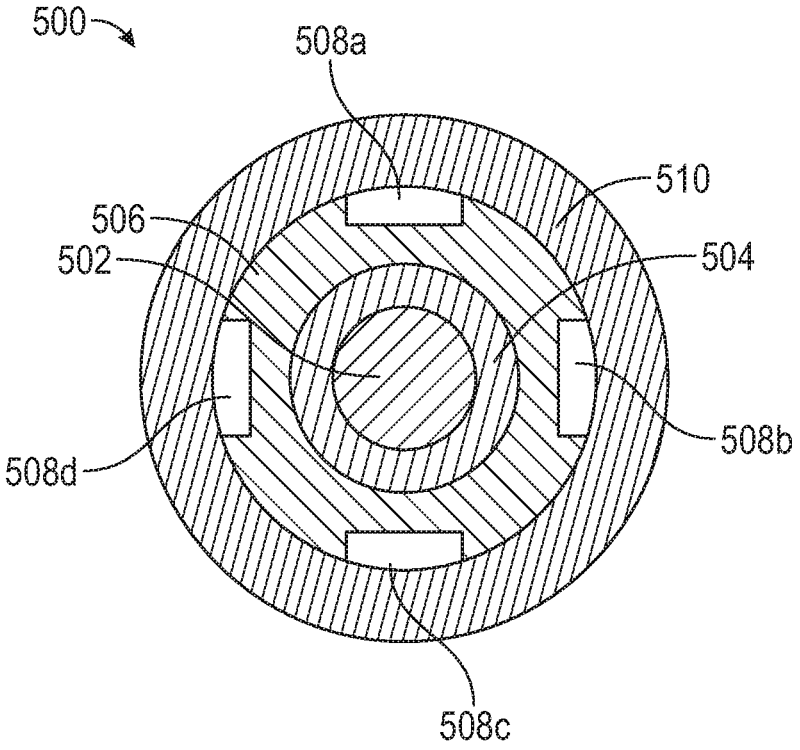
FIG. 5 is a cross sectional view of a slotted downhole cable, according to certain illustrative embodiments of the present disclosure.

FIG. 5 is a cross sectional view of a slotted downhole cable which can be implemented in any of the connection assemblies described herein, according to certain illustrative embodiments of the present disclosure. Downhole cable 500 includes a center electrical conductor 502. In certain embodiments, center electrical conductor 502 is a stranded or solid wire which may consist of various materials. A first insulator 504 is positioned around center electrical conductor 502. A second insulator 506 is positioned around first insulator 504. As shown, first insulator 504 is separate from second insulator 506. In this example, second insulator 506 includes a one or more slots/gaps 508*a,b,c,d* that extend axially along the length of the outer surface of second insulator 506. First and second insulators 504,506 are dielectric materials such as, for example, polymers like Polytetrafluoroethylene (PTFE) or Fluorinatedethylenepropylene (FEP). A pressure tube 510 is positioned around second insulator 506 and interfaces with slots 508*a-d*. Pressure tube 510 is may be made of a variety of materials, such as metal, fiber reinforced materials or other material suitable for the intended downhole application. Although slots 508*a-d* are shown as four slots, more or less slots may be used in other embodiments.

The combination of slots 508*a-d* along second insulator 506 and the two independent insulators 504 and 506 effectively stabilizes the positions of the individual parts relative to each other while at the same time providing a seal surface for the electrical termination kit to seal against, as will be described in further detail below. Slots 508*a-d* also removes insulation material which allows cable 500 to withstand the adverse expanding effects due to high temperatures. During downhole use, the harsh temperature and pressures sometimes cause the material of insulators 504,506 to expand and creep in an axial direction (along the long axis of the cable) and change shape to a point the seal will fail. The long-axis expansion occurs because there is no room for the insulation material to expand in the circumferential or axial direction. However, in the disclosed embodiments, slots 508*a-d* remedy the axial expansion this issue by allowing room for insulators 504,506 to expand circumferentially when cable and assembly sees higher temperatures and pressures. Since there is room to grow, second insulator 506 is allowed to expand in the circumferential direction whereby the material of second insulator 506 expands into slots 506*a-d*. In other words, slots 506*a-d* compress inwardly, thus allowing the insulation material to expand in a circumferential direction (reducing/eliminating expansion in the axial direction).

Although downhole cable 500 is shown has having slots 508*a-d* on the outer diameter of second insulator 506, other illustrative embodiments may have slots on the inner diameter of second insulator 506. As will be discussed later, first insulator 504 is continuously solid for 360 degrees in order to provide a continuous solid seal surface for mating boot assembly. However, also envisioned herein in alternative embodiments are examples where first insulator 504 may include slots on its inner or outer diameter. In such embodiments however, the body of first insulator 504 is still solid (no slots present) along the section of insulator 504 where the boot assembly mates, thereby providing the seal. Further, although not shown, in other illustrative embodiments the inner surface of pressure tube 510 (which mates against second insulator 506) may also have one or more slots present therein. These and other modifications of the present disclosure will be apparent to those ordinarily skilled in the art having the benefit of this disclosure.

Figure 6:
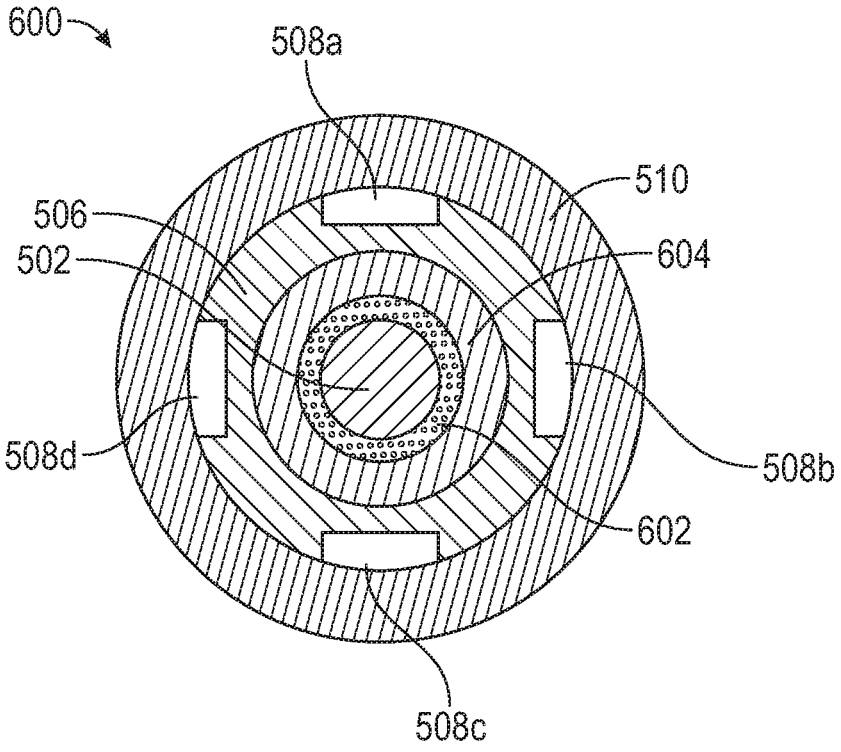
FIG. 6 is a cross sectional view of another downhole cable, according to an alternative embodiment of the present disclosure.

FIG. 6 is a cross sectional view of another downhole cable, according to an alternative embodiment of the present disclosure. Downhole cable 600 is similar to cable 500, so like elements refer to like elements. However, cable 600 replaces first insulator 504 with a mineral cable assembly. The mineral cable assembly consists of an outer pressure tube, mineral filler material, and the center conductor. Mineral filler material 602, as defined herein, is a solid dielectric material which has been reduced into small, loose particles by pounding, crushing, grinding, or similar process—also referred to herein as pulverized filler material. Examples of filler material are materials such as granules, powders, dusts or similar materials. Mineral filler material 602 is positioned around center conductor 502. A pressure tube 604 is positioned between filler material 602 and second insulator 506. Pressure tub 604 may be comprised of a variety of materials including, for example, metal or reinforced fiber. Filler material 602 may be comprised of a variety of materials including, for example, silicon, ceramic, magnesium oxide or hafnium oxide material.

As will be described in more detail below, pressure tube 604 provides a sealing surface for boot assembly to seal against when the connection of made. Given the rigid nature of pressure tube 604 (due to metal or reinforced material body), the electrical termination kit/connection will last longer and provide better support vs. conventional connections which utilize a soft plastic material to seal upon. Given the granular nature of filler material 602, it forms a 360 degree insulation layer around center conductor 502—even as pressure and heat is applied to cable 600. In addition, filler material 602 can handle much higher pressure than plastic insulation given its granular nature, thus providing a more robust insulation material in the harsh pressure and temperature environment downhole.

Figure 7:
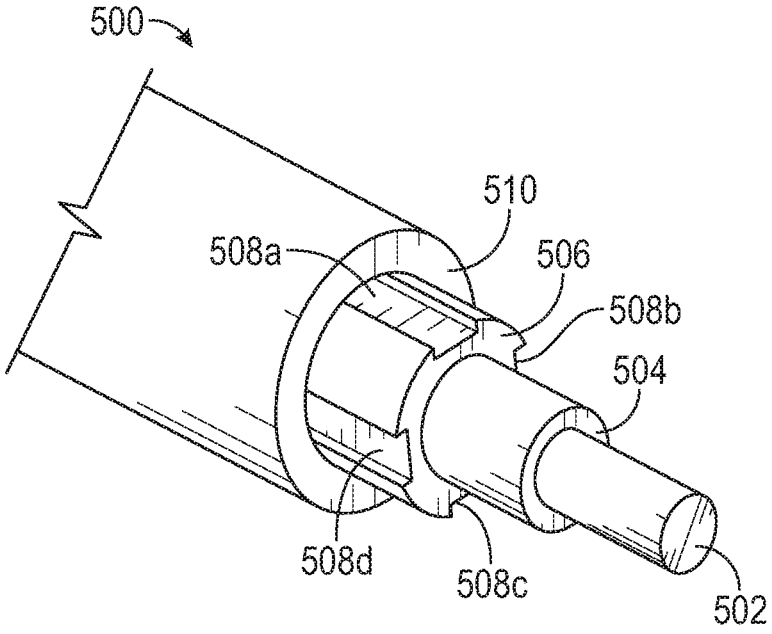
FIG. 7 is a three-dimensional view of downhole cable 500 of FIG. 5 showing a "telescoped" view of the components.

FIG. 7 is a three-dimensional view of downhole cable 500 of FIG. 5 showing a "telescoped" view of the components. The illustrated telescoped view also generally reflects the termination configuration that is prepared to connect cable 500 to the connector (termination kit), as will be described below. As can be seen, cable 500 includes center conductor 502, first insulator 504 positioned around center conductor 502, second insulator 506 positioned around first insulator 504, and pressure tube 510 positioned around second insulator 506. Second insulator 506 includes one or more slots 508*a-d* circumferentially spaced around second insulator 506, each extending axially along the length of second insulator 506.

Figure 8:
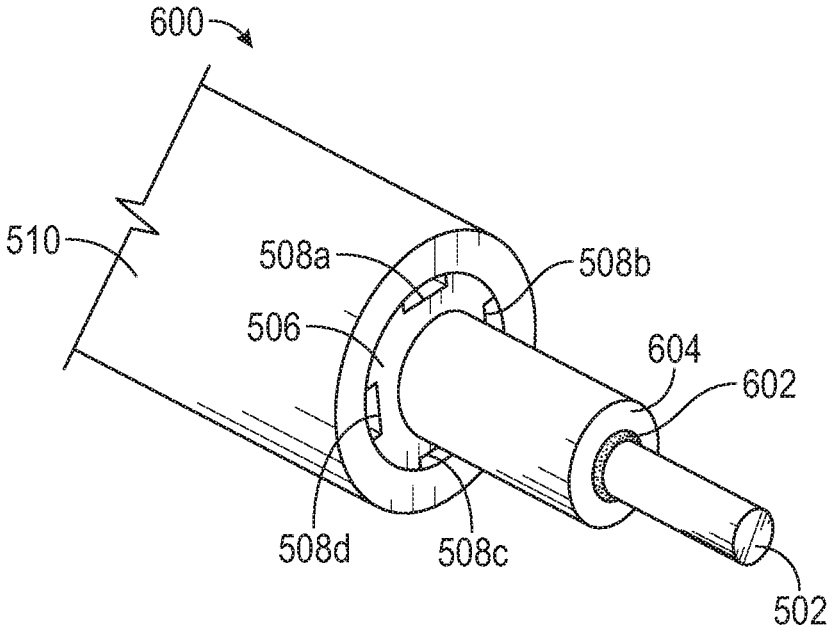
FIG. 8 is a three-dimensional view of downhole cable 600 of FIG. 6 showing a "telescoped" view of the components.

FIG. 8 is a three-dimensional view of downhole cable 600 of FIG. 6 showing a "telescoped" view of the components (although second insulator 506 is not shown in the telescoped position). The illustrated telescoped view also generally reflects the termination configuration that is prepared to connect cable 600 to the connector (termination kit), as will be described below. As can be seen, cable 600 includes center conductor 502, mineral filler 602 positioned around center conductor 502, pressure tube 604 positioned around mineral filler 602, second insulator 506 positioned around pressure tube 604, and pressure tube 510 positioned around second insulator 506. Second insulator 506 includes one or more slots 508*a-d* circumferentially spaced around second insulator 506, each extending axially along the length of second insulator 506.

Figure 9:
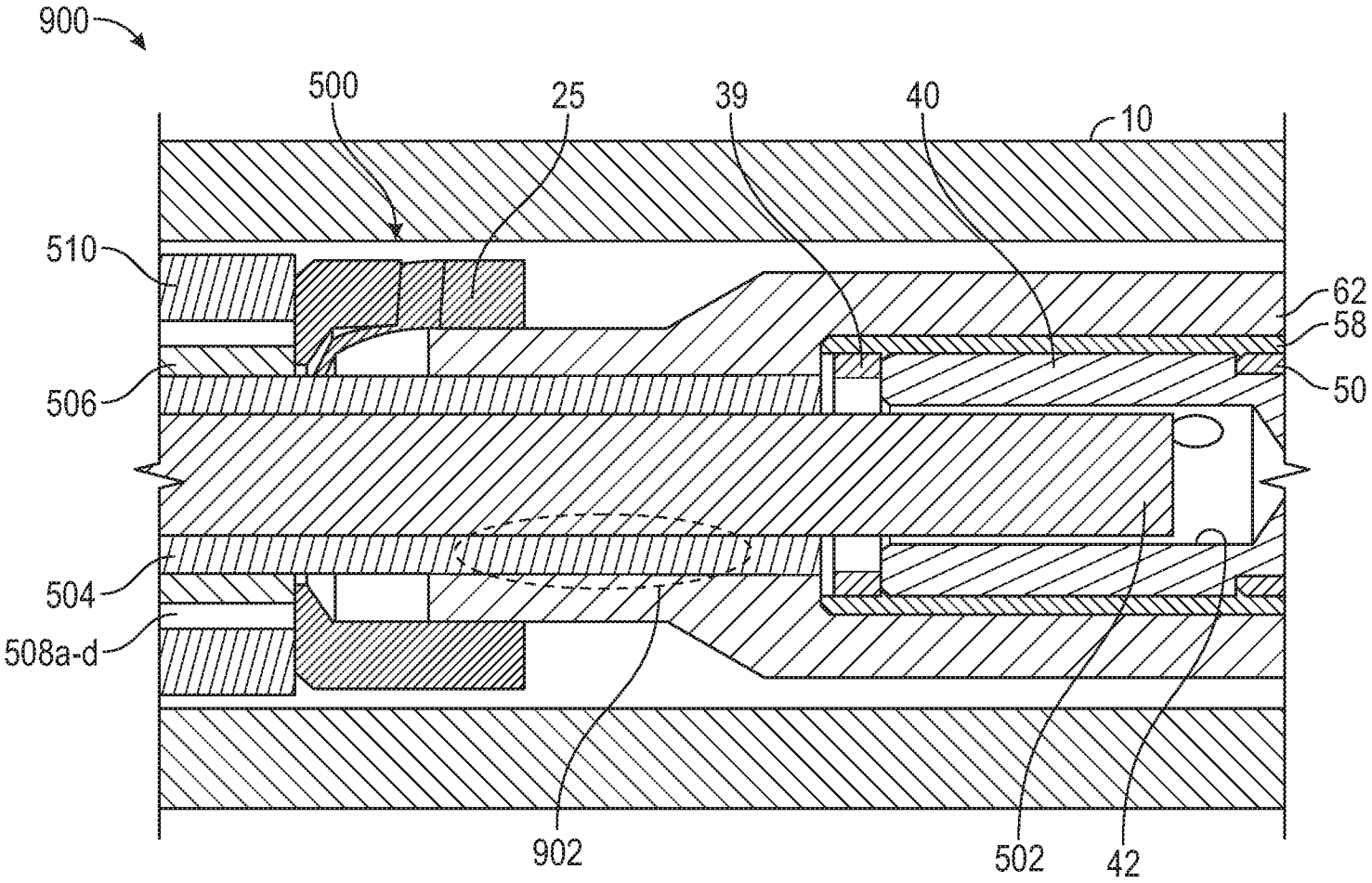
FIG. 9 illustrates a connection assembly for connecting a downhole cable to an electrical pin for use in an oil and gas application, according to certain illustrative embodiments of the present disclosure.

FIG. 9 illustrates a connection assembly for connecting a downhole cable to an electrical pin for use in an oil and gas application, according to certain illustrative embodiments of the present invention. Connection assembly 900 is similar to any of the connection assemblies described herein, thus like elements refer to like elements. This expanded view of connection assembly 900 shows downhole cable 500 positioned inside housing 10 of connector 16 as previously described. Boot 62 straddles first electrical collet 40 and first insulator 504. When cable 500 is prepared for the connection, the exposed end of cable 500 is cut such that a portion of first insulator 504 extends out beyond second insulator 506. Also, first insulator 504 is cut such that a portion of center conductor 502 extends out beyond first insulator 504 (as can be seen in the telescoped view of FIG. 7). As with any of the configurations described herein, center conductor 502 may be attached to first electrical collet 40 by a variety of means including, for example, soldering, crimping, epoxy or shrink rings.

As can be seen in FIGS. 7 and 9, boot 62 seals around the portion of first insulator 504 which extends out beyond second insulator 506. This ensures slots 508*a-d* do not interfere with the sealing function. Boot 62 seals around entire 360-degree outer diameter of first insulator 504 at seal area 902. Seal 902 helps to prevent fluid intrusion inside first recess 42 of first electrical collet 40, which could lead to short circuits or other connection failures. Also, in this embodiment second insulator 506 and pressure tube 510 are cut flush with one another. An electrically insulating lateral support 25 is positioned at the base of boot 62 to provide lateral support if the internals of cable 500 move excessively in either direction. Although not shown, first electrical collet 40 of the connector 16 attaches center conductor 502 (in a first end at first recess 42) to electrical pin 16 (at a second end opposite the first end) to establish the electrical connection, as previously described herein.

Figure 10:
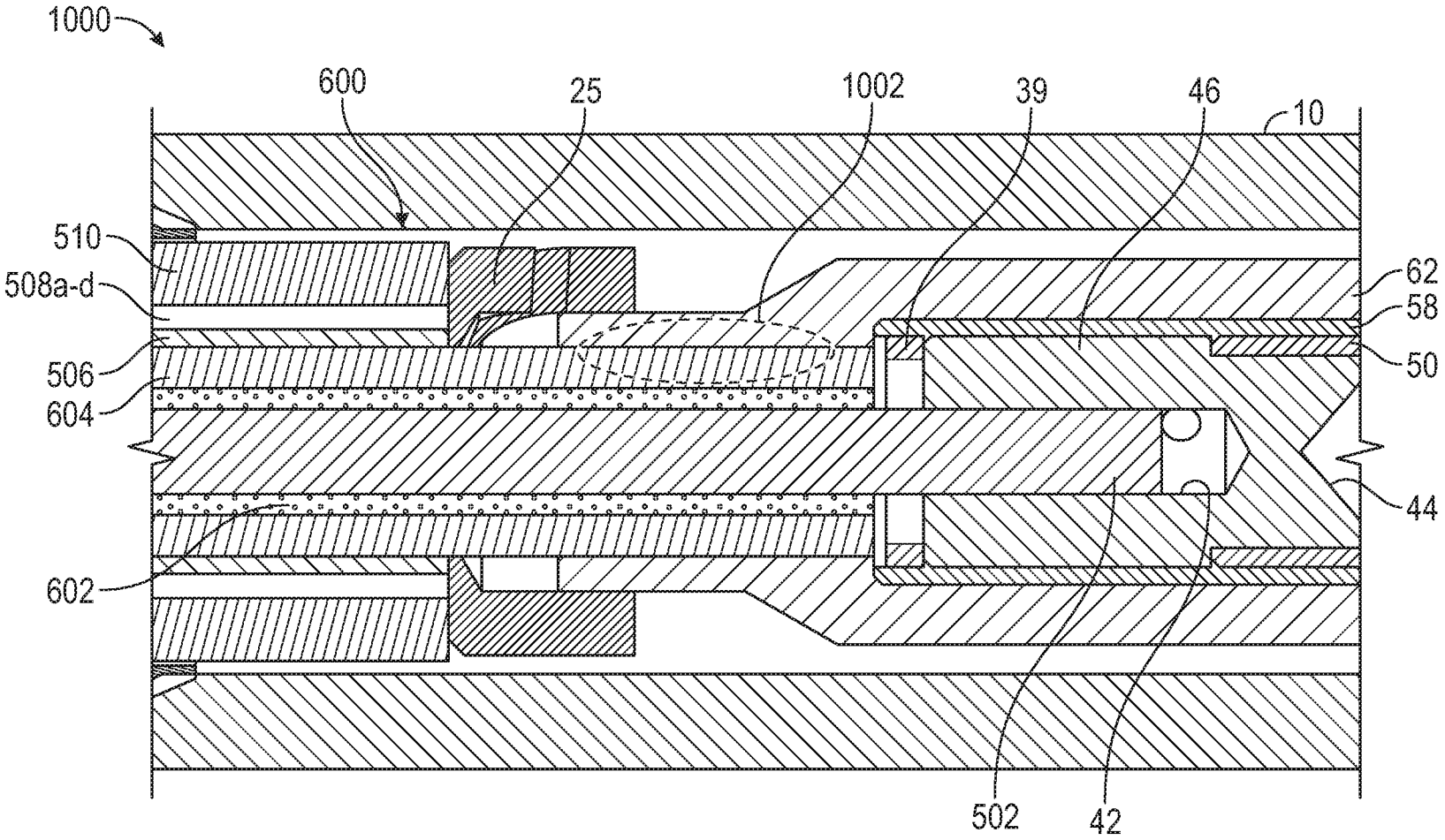
FIG. 10 illustrates a connection assembly for connecting a downhole cable to an electrical pin for use in an oil and gas application, according to certain illustrative embodiments of the present invention.

FIG. 10 illustrates a connection assembly for connecting a downhole cable to an electrical pin for use in an oil and gas application, according to certain illustrative embodiments of the present invention. Connection assembly 1000 is similar to any of the connection assemblies described herein, thus like elements refer to like elements. This expanded view of connection assembly 1000 shows downhole cable 600 positioned inside housing 10 of connector 16 as previously described. Boot 62 straddles first electrical collet 40 and pressure tube 604. As previously described, pressure tube 604 may be a metallic tube, fiber reinforced tube or some other ridged tubing. When cable 600 is prepared for the connection, the exposed end of cable 600 is cut such that a portion of pressure tube 604 and filler material 602 extends out beyond second insulator 506. Also, pressure tube 604 and filler material 602 are cut flush with one another such that a portion of center conductor 502 extends out beyond pressure tube 604 and filler material 602 (as can be seen in the telescoped view of FIG. 8). As with any of the configurations described herein, center conductor 502 may be attached to first electrical collet 40 by a variety of means including, for example, soldering, crimping, epoxy or shrink rings.

As can be seen in FIGS. 8 and 10, boot 62 seals around the portion of pressure tube 604 which extends out beyond second insulator 506. Boot 62 seals around entire 360 degree outer diameter of pressure tube 604 at seal area 1002. Seal 1002 helps to prevent fluid intrusion inside first recess 42 of first electrical collet 40, which could lead to short circuits or other connection failures. Also, in this embodiment second insulator 506 and pressure tube 510 are cut flush with one another. Electrically insulating lateral support 25 is positioned at the base of boot 62, as previously described. Although not shown, first electrical collet 40 of the connector 16 attaches center conductor 502 (in a first end at first recess 42) to electrical pin 16 (at a second end opposite the first end) to establish the electrical connection, as previously described herein.

Figure 11:
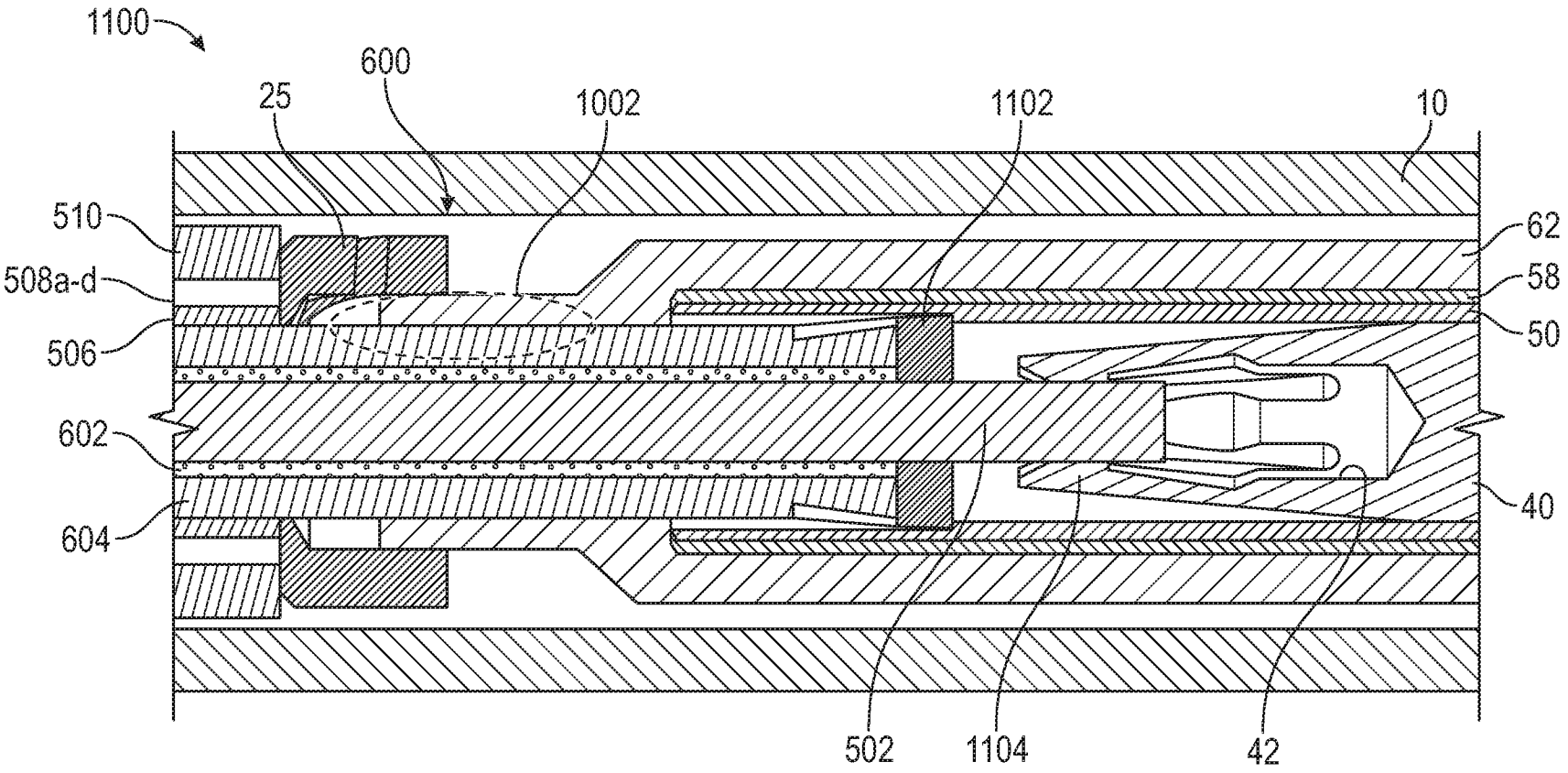
FIG. 11 illustrates a connection assembly for connecting a downhole cable to an electrical pin for use in an oil and gas application, according to certain illustrative embodiments of the present invention.

FIG. 11 illustrates a connection assembly for connecting a downhole cable to an electrical pin for use in an oil and gas application, according to certain illustrative embodiments of the present invention. Connection assembly 1100 is similar to connection assembly 1000, thus like elements refer to like elements. However, in this embodiment, insulator 58 and sleeve 50 extend out over a portion of pressure tube 604 which, in this example, is a metallic conductive tube. A collet finger 1102 is secured inside sleeve 50 to provide an additional electrical contact with the outer surface of metallic tube 604. Also, first electrical collet 40 includes collet fingers 1104 which receive and make electrical contact with center conductor 502. The use of collet finger 1102 and 1104 result in a more robust and reliable connection. Connection assembly 1100 might also be referred to as a "push on" or "snap on" termination kit because, unlike conventional connections which must be soldered, crimped, etc., connection assembly 1100 can be easily snapped in place by operators in the field. Conventional connections require the field operators to have specialized experience and/or certifications in order to make the electrical connections. However, with connection assembly 1100, any operator may make reliable connections in the field, resulting in a more efficient downhole operation and/or completion.

Figure 12:
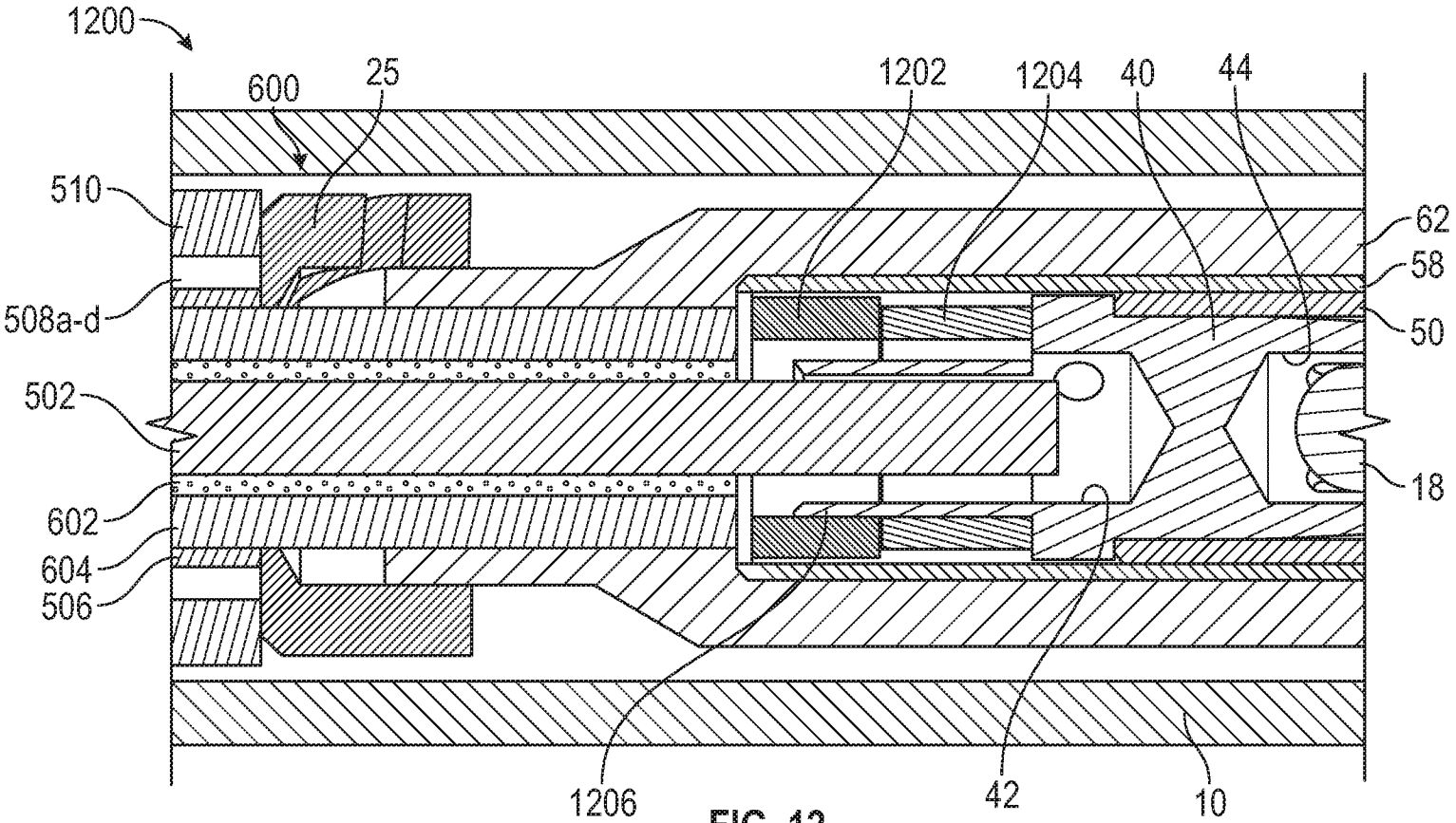
FIG. 12 illustrates a connection assembly for connecting a downhole cable to an electrical pin for use in an oil and gas application, according to certain illustrative embodiments of the present invention.

FIG. 12 illustrates a connection assembly for connecting a downhole cable to an electrical pin for use in an oil and gas application, according to certain illustrative embodiments of the present invention. Connection assembly 1200 is similar to connection assembly 1100, thus like elements refer to like elements. However, in this embodiment, insulator 58 houses a spacer 1202 at its base. A shrink ring 1204 is positioned adjacent spacer 1202 within insulator 58. Shrink ring 12 is positioned around a series of collet fingers 1206 which extend outwardly from collet 40. Center conductor 502 is positioned inside the portion of collet 40 having the reduced diameter. During assembly of the electrical connection, shrink ring 1204 could be activated using a variety of means such as, for example, localized resistance heating, localized inductive heating, chemical heating or capacitive heating. As shrink ring 1204 heats, it shrinks around collet fingers 1206 which forces each finger 1206 to secure against center conductor 502, thereby securing the electrical connection.

Figure 13:
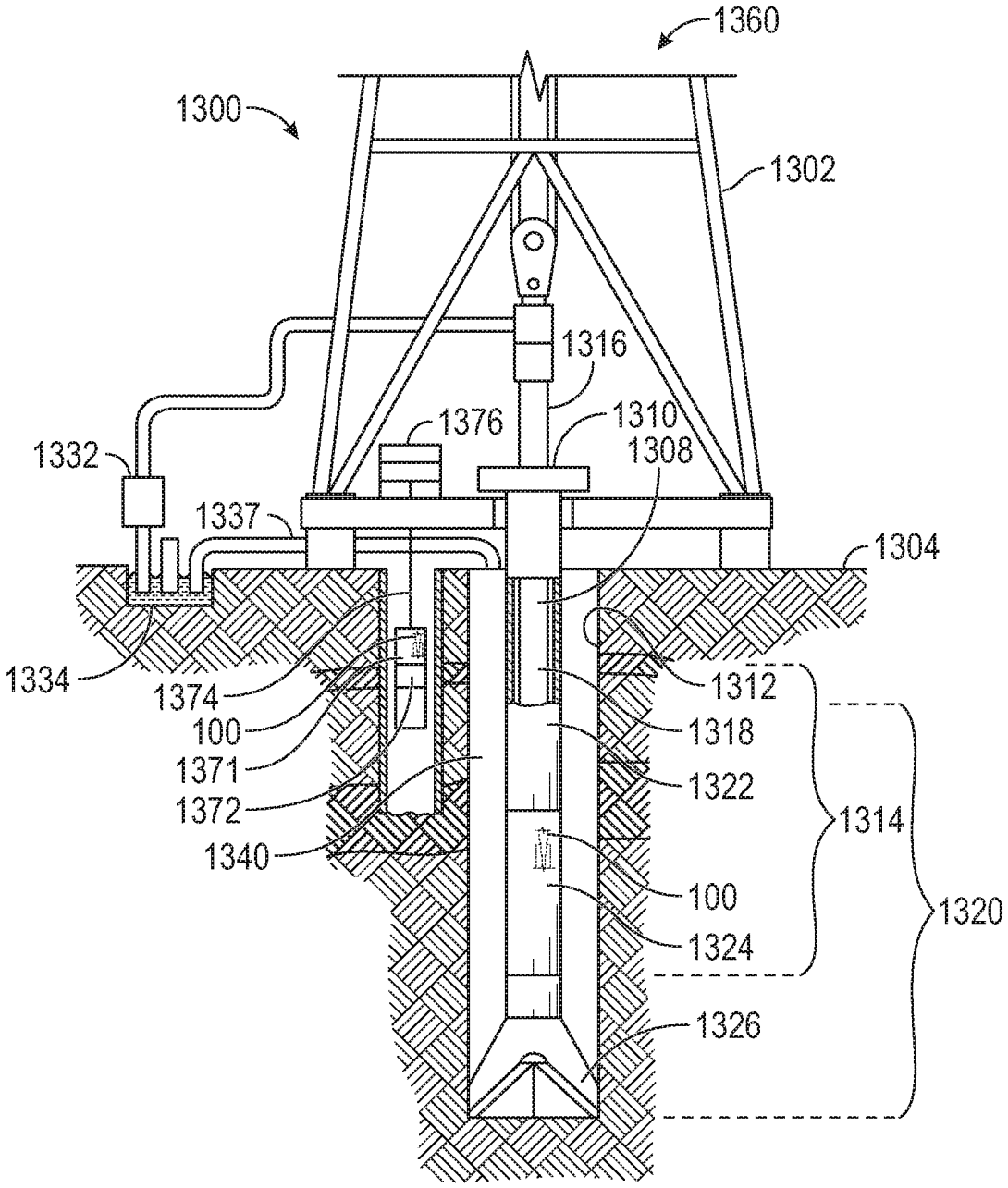
FIG. 13 shows an illustrative drilling and wireline application in which the disclosed embodiments may be utilized.

FIG. 13 shows an illustrative drilling and wireline application in which the disclosed embodiments may be utilized. System 1300 includes a drilling rig 1302 located at a surface 1304 of a wellbore. Drilling rig 1302 provides support for a downhole apparatus, including a drill string 1308. Drill string 1308 penetrates a rotary table 1310 for drilling a borehole/wellbore 1312 through subsurface formations 1314. Drill string 1308 includes a Kelly 1316 (in the upper portion), a drill pipe 1318 and a bottomhole assembly 1320 (located at the lower portion of drill pipe 1318). In certain illustrative embodiments, bottomhole assembly 1320 may include drill collars 1322, a downhole tool 1324 and a drill bit 1326. Downhole tool 1324 may be any of a number of different types of tools including measurement-while-drilling ("MWD") tools, logging-while-drilling ("LWD") tools, etc.

During drilling operations, drill string 1308 (including Kelly 1316, drill pipe 1318 and bottom hole assembly 1320) may be rotated by rotary table 1310. In addition or alternative to such rotation, bottom hole assembly 1320 may also be rotated by a motor that is downhole. Drill collars 1322 may be used to add weight to drill bit 1326. Drill collars 1322 also optionally stiffen bottom hole assembly 1320 allowing it to transfer the weight to drill bit 1326. The weight provided by drill collars 1322 also assists drill bit 1326 in the penetration of surface 1304 and subsurface formations 1314.

During drilling operations, a mud pump 1332 optionally pumps drilling fluid (e.g., drilling mud), from a mud pit 1334 through a hose 1336, into drill pipe 1318, and down to drill bit 1326. The drilling fluid can flow out from drill bit 1326 and return back to the surface through an annular area 1340 between drill pipe 1318 and the sides of borehole 1312. The drilling fluid may then be returned to the mud pit 1334, for example via pipe 1337, and the fluid is filtered. The drilling fluid cools drill bit 1326, as well as provides for lubrication of drill bit 1326 during the drilling operation. Additionally, the drilling fluid removes the cuttings of subsurface formations 1314 created by drill bit 1326.

Still referring to FIG. 13, downhole tool 1324 may also include any number of sensors which monitor different downhole parameters and generate data that is stored within one or more different storage mediums within downhole tool 1324. Alternatively, however, the data may be transmitted to a remote location (e.g., surface) and processed accordingly. Such parameters may include logging data related to the various characteristics of the subsurface formations (such as resistivity, radiation, density, porosity, etc.) and/or the characteristics of the borehole (e.g., size, shape, etc.), etc.

The electrical cables and connection assemblies described herein may be implemented into bottomhole assembly 1320 in a variety of ways. In FIG. 13, electrical connection assembly 100 is positioned inside downhole tool 1324 to provide power and/or data to downhole tool 1324 or other components downhole. Although not shown, in such embodiments, connection assembly 100 is coupled to a power or data source further uphole or on surface 1304.

FIG. 13 also illustrates an alternative embodiment in which a wireline system is deployed. In such an embodiment, the wireline system may include a downhole tool body 1371 coupled to a base 1376 by a logging cable 1374. Logging cable 1374 may include, but is not limited to, a wireline (multiple power and communication lines), a mono-cable (a single conductor), and a slick-line (no conductors for power or communications). Base 1376 is positioned above ground and optionally includes support devices, communication devices, and computing devices. Tool body 1371 may houses one or more sensors 1372. In an embodiment, a power source (not shown) is positioned in tool body 1371 to provide power to the tool 1371. However, in other embodiments, connection assembly 100 is positioned inside tool body 1371 in order to provide power and/or data to/from downhole devices as previously described.

In operation, the wireline system is typically sent downhole after the completion of a portion of the drilling. More specifically, in certain methods, drill string 1308 creates borehole 1312, then drill string 1308 is removed, and the wireline system is inserted into borehole 1312, as will be understood by those ordinarily skilled in the art having the benefit of this disclosure. Note that only one borehole is shown for simplicity in order to show the tools deployed in drilling and wireline applications. In certain applications, such as ranging, multiple boreholes would be drilled as understood in the art.

Accordingly, the disclosed downhole electrical cables provide improved temperature and pressure resistance in the harsh downhole environment. The slotted feature allows downhole electrical systems to be used in higher temperature and pressure environments when compared to conventional electrical cables. The disclosed cables are also more forgiving if operators need to route the cables such that bends are tight/small relative to the cable OD (outer diameter). The slots in the insulators also result in less insulation material being required when manufacturing the disclosed cables, thus resulting in cheaper manufacturing costs. In addition, the cables further stabilize the connection assemblies and may be used in any variety of oil and gas applications. Illustrative applications include, for example, subsea or downhole completion strings, drilling strings, wirelines, LWD strings, etc. and/or any components associated therewith. Further, the disclosed downhole cables and connection assemblies may also be implemented in any other applications which require electrical connections that can withstand high temperatures and/or pressures.

Embodiments and methods of the present disclosure described herein further relate to any one or more of the following paragraphs:

1. A high-pressure electrical connection assembly for connecting an electrical conductor to an electrical pin for use in an oil and gas application, comprising a housing having a bore therein to receive the electrical conductor; and a connector positioned within the bore to receive the electrical conductor in a first end and the electrical pin in a second end to thereby maintain electrical contact between the electrical conductor and electrical pin, wherein the connector comprises: a first electrical collet having a first recess in a first end to receive the electrical conductor and a second recess in a second end to receive the electrical pin, the first electrical collet being in electrical contact with the electrical pin; a second electrical collet to receive the electrical pin, the second electrical collet being separate from the first electrical collet and being in electrical contact with the electrical pin; and a sleeve positioned around the electrical pin, mechanical collet and the electrical collet.

2. The high-pressure electrical connection assembly as defined in paragraph 1, wherein the first electrical collect comprises contact faces on the second end which compress against the electrical pin; and the electrical pin comprises an upset diameter face which mates against the contact faces of the first electrical collet when the electrical pin is moved in a direction away from the electrical conductor.

3. The high-pressure electrical connection assembly as defined in paragraphs 1 or 2, wherein the second electrical collet comprises a first end in contact with the sleeve and a second end compressed against electrical pin.

4. The high-pressure electrical connection assembly as defined in any of paragraphs 1-3, wherein the first electrical collet is made of a copper alloy; and the second electrical collet is made of a nickel alloy.

5. The high-pressure electrical connection assembly as defined in any of paragraphs 1-4, wherein the first electrical collet has a first resonance; and the second electrical collet has a second resonance different from the first resonance.

6. The high-pressure electrical connection assembly as defined in any of paragraphs 1-5, further comprising a first insulator positioned around the connector; and a boot seal positioned around the first insulator.

7. The high-pressure electrical connection assembly as defined in any of paragraphs 1-6, further comprising a sapphire sleeve positioned around the electrical pin, the sapphire sleeve being axially separated from the sleeve along the electrical pin, wherein the first insulator and the boot insulator each straddle the sleeve and sapphire sleeve.

8. The high-pressure electrical connection assembly as defined in any of paragraphs 1-7, further comprising a shape memory shrink ring positioned around the sapphire sleeve to thereby secure the sapphire sleeve to the electrical pin.

9. The high-pressure electrical connection assembly as defined in any of paragraphs 1-8, wherein the connection assembly is part of subsea or downhole completion string.

10. A high-pressure electrical connection assembly for connecting an electrical conductor to an electrical pin for use in an oil and gas application, comprising a housing having a bore therein to receive the electrical conductor; and a connector positioned within the bore to receive the electrical conductor in a first end and the electrical pin in a second end, wherein the connector comprises a first electrical collet in electrical contact with the electrical conductor and the electrical pin; and a second electrical collet in electrical contact with the electrical pin, the second electrical collet being separate from the first electrical collet.

11. The high-pressure electrical connection assembly as defined in paragraph 10, further comprising a sleeve to positioned around the electrical pin, first electrical collet and the second electrical collet.

12. The high-pressure electrical connection assembly as defined in paragraphs 10 or 11, wherein the second electrical collet comprises a first end in contact with the sleeve and a second end compressed against the electrical pin.

13. The high-pressure electrical connection assembly as defined in any of paragraphs 10-12, wherein the first electrical collect comprises contact faces on the second end which compress against the electrical pin; and the electrical pin comprises an upset diameter face which mates against the contact faces of the first electrical collet when the electrical pin is moved in a direction away from the electrical conductor.

14. The high-pressure electrical connection assembly as defined in any of paragraphs 10-13, wherein the first electrical collet is made of a copper alloy; and the second electrical collet is made of a nickel alloy.

15. The high-pressure electrical connection assembly as defined in any of paragraphs 10-14, wherein the first electrical collet has a first resonance; and the second electrical collet has a second resonance different from the first resonance.

16. The high-pressure electrical connection assembly as defined in any of paragraphs 10-15, further comprising a first insulator positioned around the connector; and a boot seal positioned around the first insulator.

17. The high-pressure electrical connection assembly as defined in any of paragraphs 10-16, further comprising a sapphire sleeve positioned around the electrical pin, wherein the sapphire sleeve is axially separated from the sleeve along the electrical pin.

18. The high-pressure electrical connection assembly as defined in any of paragraphs 10-17, further comprising a shape memory shrink ring positioned around the sapphire sleeve to thereby secure the sapphire sleeve to the electrical pin.

19. The high-pressure electrical connection assembly as defined in any of paragraphs 10-18, wherein the connection assembly is part of subsea or downhole completion string.

20. A method to fabricate a high-pressure electrical connection assembly for connecting an electrical conductor to an electrical pin for use in an oil and gas application, the method comprising providing a housing having a bore therein to receive the electrical conductor; and providing a connector positioned within the bore to receive the electrical conductor in a first end and the electrical pin in a second end, wherein the connector comprises a first electrical collet in electrical contact with the electrical conductor and the electrical pin; and a second electrical collet in electrical contact with the electrical pin, the second electrical collet being separate from the first electrical collet.

21. The method of paragraph 20, further comprising providing the first electrical collect with contact faces that compress against the electrical pin; and providing the electrical pin with an upset diameter face that mates against the contact faces of the first electrical collet when the electrical pin is moved in a direction away from the electrical conductor.

22. The method of paragraphs 20 or 21, wherein the first electrical collet is made of a copper alloy; and the second electrical collet is made of a nickel alloy.

23. The method of any of paragraphs 20-22, wherein a configuration of the first electrical collet is selected such that the first electrical collet has a first resonance; and a configuration of the second electrical collet is selected such that the second electrical collet has a second resonance different from the first resonance frequency.

24. A high-pressure electrical connection assembly for connecting an electrical conductor to an electrical pin for use in an oil and gas application, comprising a housing having a bore therein to receive the electrical conductor; and a connector positioned within the bore to receive the electrical conductor in a first end and the electrical pin in a second end, wherein the connector comprises a first electrical collet having a configuration selected to correspond to a first resonance; a second electrical collet having a configuration selected to correspond to a second resonance different from the first resonance.

25. The high-pressure electrical connection assembly as defined in paragraph 24, wherein the first electrical collect comprises contact faces which compress against the electrical pin; and the electrical pin comprises an upset diameter face which mates against the contact faces of the first electrical collet when the electrical pin is moved in a direction away from the electrical conductor.

26. A method to fabricate a high-pressure electrical connection assembly for connecting an electrical conductor to an electrical pin for use in an oil and gas application, the method comprising providing a housing having a bore therein to receive the electrical conductor; providing a connector positioned within the bore to receive the electrical conductor in a first end and the electrical pin in a second end, the connector including a first electrical collet and a separate second electrical collet; selecting a configuration of the first electrical collet that corresponds to a first resonance; and selecting a configuration of the second electrical collet that corresponds to a second resonance different from the first resonance.

27. The method of paragraph 26, further comprising providing the first electrical collect with contact faces that compress against the electrical pin; and providing the electrical pin with an upset diameter face that mates against the contact faces of the first electrical collet when the electrical pin is moved in a direction away from the electrical conductor.

28. A downhole cable for use in an oil and gas application, comprising a center electrical conductor; a first insulator positioned around the center electrical conductor; a second insulator positioned around the first insulator; and a pressure tube surrounding the second insulator, wherein the cable further comprises at least one of one or more slots extending axially along a length of the second insulator; or one or more slots extending axially along an inner diameter of the pressure tube.

29. The downhole cable as defined in paragraph 28, wherein the second insulator comprises an inner surface in contact with the first insulator; and an outer surface, wherein the one or more slots extend axially along the inner surface or outer surface of the second insulator.

30. The downhole cable as defined in paragraphs 28 or 29, wherein the first and second insulators comprise a polymer material.

31. The downhole cable as defined in any of paragraphs 28-30, wherein the first insulator is a dielectric, pulverized filler material; and the cable further comprises a metallic tube positioned between the filler material and the second insulator.

32. The downhole cable as defined in any of paragraphs 28-31, wherein the filler material is a mineral granule, powder or dust material.

33. The downhole cable as defined in any of paragraphs 28-32, wherein the filler material is a silicon, ceramic, magnesium oxide or hafnium oxide material.

34. A method for fabricating a downhole cable for use in an oil and gas application, comprising providing a center electrical conductor; providing a first insulator positioned around the center electrical conductor; providing a second insulator positioned around the first insulator; and providing a pressure tube surrounding the second insulator, wherein the cable further comprises at least one of: one or more slots extending axially along a length of the second insulator; or one or more slots extending axially along an inner diameter of the pressure tube.

35. The method as defined in paragraph 34, wherein the second insulator comprises an inner surface in contact with the first insulator; and an outer surface, wherein the one or more slots extend axially along the inner surface or outer surface of the second insulator.

36. The method as defined in paragraph 34 or 35, wherein the first and second insulators comprise a polymer material.

37. The method as defined in any of paragraphs 34-36, wherein the first insulator is a dielectric, pulverized filler material; and the cable further comprises a metallic tube positioned between the filler material and the second insulator.

38. The method as defined in any of paragraphs 34-37, wherein the filler material is a mineral granule, powder or dust material.

39. The method as defined in any of paragraphs 34-38, wherein the filler material is a silicon, ceramic, magnesium oxide or hafnium oxide material.

40. A connection assembly for connecting a downhole cable to an electrical pin for use in an oil and gas application, comprising a housing having a bore therein to receive the cable, wherein the cable comprises: a center electrical conductor; a first insulator positioned around the center electrical conductor; a second insulator positioned around the first insulator; and a pressure tube surrounding the second insulator, wherein the cable further comprises at least one of: one or more slots extending axially along a length of the second insulator; or one or more slots extending axially along an inner diameter of the pressure tube; and a connector positioned within the bore to receive the center electrical conductor in a first end and the electrical pin in a second end, thereby establishing an electrical connection.

41. The connection assembly as defined in paragraph 40, wherein at one end of the cable, a portion of the first insulator extends out beyond the second insulator, and a portion of the center electrical conductor extends out beyond the first insulator; the connector receives the portion of the center electrical conductor that extends out beyond the first insulator in the first end and the electrical pin in the second end, thereby establishing an electrical connection; and the connection assembly further comprises a boot seal that is sealingly engaged around the portion of the first insulator that extends out beyond the second insulator.

42. The connection assembly as defined in paragraphs 40 and 41, wherein the connector comprises a shrink ring at the first end which, when activated, forces collet fingers of the connector into electrical contact with the center electrical conductor.

43. The connection assembly as defined in any of paragraphs 40-42, wherein the second insulator comprises an inner surface in contact with the first insulator; and an outer surface, wherein the one or more slots extend axially along the inner surface or outer surface of the second insulator.

44. The connection assembly as defined in any of paragraphs 40-43, wherein the first and second insulators comprise a polymer material.

45. The connection assembly as defined in any of paragraphs 40-44, wherein the first insulator is a dielectric, pulverized filler material; and the cable further comprises a metallic tube positioned between the filler material and the second insulator.

46. The connection assembly as defined in any of paragraphs 40-45, wherein the filler material is a mineral granule, powder or dust material.

47. The connection assembly as defined in any of paragraphs 40-46, wherein the filler material is a silicon, ceramic, magnesium oxide or hafnium oxide material.

48. The connection assembly as defined in any of paragraphs 40-47, wherein at one end of the cable, a portion of the metallic tube and filler material extends out beyond the second insulator, and a portion of the center electrical conductor extends out beyond the metallic tube and filler material; the connector receives the portion of the center electrical conductor that extends out beyond the metallic tube and filler material in the first end and the electrical pin in the second end, thereby establishing an electrical connection; and a boot seal that is sealingly engaged around the portion of the metallic tube that extends out beyond the second insulator.

49. The connection assembly as defined in any of paragraphs 40-48, wherein the connector further comprises at least one of first collet fingers in the first end that make electrical contact with center electrical conductor; and second collet fingers in the first end that make electrical contact with the metallic tube.

Although various embodiments and methods have been shown and described, the present disclosure is not limited to such embodiments and methods and will be understood to include all modifications and variations as would be apparent to one skilled in the art. Therefore, it should be understood that this disclosure is not intended to be limited to the particular forms disclosed. Rather, the intention is to cover all modifications, equivalents and alternatives falling within the spirit and scope of the disclosure as defined by the appended claims.

What is claimed is:

1. A downhole cable for use in an oil and gas application, comprising:
- a center electrical conductor;
- a first insulator in contact with and positioned around the center electrical conductor;
- a second insulator in contact with and positioned around the first insulator; and
- a pressure tube in contact with and positioned around the second insulator,
- wherein the cable further comprises at least one of:
  - one or more slots extending axially along a length of the second insulator; or
  - one or more slots extending axially along an inner diameter of the pressure tube.

2. The downhole cable as defined in claim 1, wherein the second insulator comprises: an inner surface in contact with the first insulator; and
- an outer surface,
- wherein the one or more slots extend axially along the inner surface or outer surface of the second insulator.

3. The downhole cable as defined in claim 2, wherein the first and second insulators comprise a polymer material.

4. The downhole cable as defined in claim 1, wherein:
- the first insulator is a dielectric, pulverized filler material; and
- the first insulator further comprises a metallic tube positioned around the filler material.

5. The downhole cable as defined in claim 4, wherein the filler material is a mineral granule, powder or dust material.

6. The downhole cable as defined in claim 4, wherein the filler material is a silicon, ceramic, magnesium oxide or hafnium oxide material.

7. A method for fabricating a downhole cable for use in an oil and gas application, comprising:
- providing a center electrical conductor;
- providing a first insulator in contact with and positioned around the center electrical conductor;
- providing a second insulator in contact with and positioned around the first insulator; and
- providing a pressure tube in contact with and positioned around the second insulator,
- wherein the cable further comprises at least one of:
  - one or more slots extending axially along a length of the second insulator; or
  - one or more slots extending axially along an inner diameter of the pressure tube.

8. The method as defined in claim 7, wherein the second insulator comprises: an inner surface in contact with the first insulator; and
- an outer surface,
- wherein the one or more slots extend axially along the inner surface or outer surface of the second insulator.

9. The method as defined in claim 8, wherein the first and second insulators comprise a polymer material.

10. The method as defined in claim 7, wherein:

the first insulator is a dielectric, pulverized filler material; and the first insulator further comprises a metallic tube positioned around the filler material.

11. The method as defined in claim 10, wherein the filler material is a mineral granule, powder, dust material, silicon, ceramic, magnesium oxide or hafnium oxide material.

12. A connection assembly for connecting a downhole cable to an electrical pin for use in an oil and gas application, comprising:

a housing having a bore therein to receive the cable, wherein the cable comprises:

a center electrical conductor;

a first insulator in contact with and positioned around the center electrical conductor;

a second insulator in contact with and positioned around the first insulator; and a pressure tube in contact with and positioned around the second insulator, wherein the cable further comprises at least one of:

one or more slots extending axially along a length of the second insulator; or one or more slots extending axially along an inner diameter of the pressure tube; and a connector positioned within the bore to receive the center electrical conductor in a first end and the electrical pin in a second end, thereby establishing an electrical connection.

13. The connection assembly as defined in claim 12, wherein:

at one end of the cable, a portion of the first insulator extends out beyond the second insulator, and a portion of the center electrical conductor extends out beyond the first insulator; the connector receives the portion of the center electrical conductor that extends out beyond the first insulator in the first end and the electrical pin in the second end, thereby establishing an electrical connection; and the connection assembly further comprises a boot seal that is sealingly engaged around the portion of the first insulator that extends out beyond the second insulator.

14. The connection assembly as defined in claim 12, wherein the connector comprises a shrink ring at the first end which, when activated, forces collet fingers of the connector into electrical contact with the center electrical conductor.

15. The connection assembly as defined in claim 12, wherein the second insulator comprises:

an inner surface in contact with the first insulator; and an outer surface, wherein the one or more slots extend axially along the inner surface or outer surface of the second insulator.

16. The connection assembly as defined in claim 15, wherein the first and second insulators comprise a polymer material.

17. The connection assembly as defined in claim 12, wherein:

the first insulator is a dielectric, pulverized filler material; and the first insulator further comprises a metallic tube positioned around the filler material.

18. The connection assembly as defined in claim 17, wherein the filler material is a mineral granule, powder, dust material, silicon, ceramic, magnesium oxide or hafnium oxide.

19. The connection assembly as defined in claim 17, wherein:

at one end of the cable, a portion of the metallic tube and filler material extends out beyond the second insulator, and a portion of the center electrical conductor extends out beyond the metallic tube and filler material;

the connector receives the portion of the center electrical conductor that extends out beyond the metallic tube and filler material in the first end and the electrical pin in the second end, thereby establishing an electrical connection; and a boot seal that is sealingly engaged around the portion of the metallic tube that extends out beyond the second insulator.

20. The connection assembly as defined in claim 19, wherein the connector further comprises at least one of:

first collet fingers in the first end that make electrical contact with center electrical conductor; and second collet fingers in the first end that make electrical contact with the metallic tube.

* * * * *